US006454132B2

(12) United States Patent
Campion

(10) Patent No.: US 6,454,132 B2
(45) Date of Patent: Sep. 24, 2002

(54) PRESSURE-ASSISTED LIQUID DELIVERY SYSTEM

(76) Inventor: Christopher R. Campion, G/F, 110 Man Nin Street, Sai Kung, Kowloon (HK)

( * ) Notice: Subject to any disclaimer, the term of this patent is extended or adjusted under 35 U.S.C. 154(b) by 0 days.

(21) Appl. No.: 09/835,255

(22) Filed: Apr. 14, 2001

Related U.S. Application Data

(63) Continuation-in-part of application No. 09/513,322, filed on Feb. 25, 2000.
(60) Provisional application No. 60/197,336, filed on Apr. 14, 2000.

(51) Int. Cl.[7] ..... B65D 35/54
(52) U.S. Cl. ..... 222/96; 222/105
(58) Field of Search ..... 222/1, 103, 105, 222/214, 96

(56) References Cited

U.S. PATENT DOCUMENTS

| | | | | | |
|---|---|---|---|---|---|
| 3,960,294 | A | * | 6/1976 | Bernard | 222/103 |
| 4,284,209 | A | * | 8/1981 | Barbour, Jr. | 222/1 |
| 4,848,594 | A | * | 7/1989 | Bjorkengren et al. | 222/1 |
| 5,342,313 | A | * | 8/1994 | Campbell et al. | 222/103 |
| 5,857,592 | A | * | 1/1999 | Hyldgaard et al. | 222/103 |

* cited by examiner

*Primary Examiner*—William C. Doerrler
*Assistant Examiner*—Thach H. Bui
(74) *Attorney, Agent, or Firm*—Brian Beverly

(57) ABSTRACT

A pressure-assisted liquid delivery system comprises a flexible reservoir having an exit port and demand valve, a pair of substantially rigid plates for sandwiching the reservoir, and a plurality of loops of elastic rope for compressing the plates around and pressurizing the reservoir such that liquid contents thereof are expelled through the valve when it is opened without application of a suction force.

32 Claims, 3 Drawing Sheets

PRESSURE-ASSISTED LIQUID DELIVERY SYSTEM

This is a continuation-in-part of Application Ser. 09/513,322, filed Feb. 25, 2000, and which is still pending. This application also claims the benefit of U.S. Provisional application No. 60/197,336, filed Apr. 14, 2000.

BACKGROUND OF THE INVENTION

Hydration systems for sports enthusiasts, workers, and others engaged in a high level of physical activity typically consist of a textile backpack or waist pack (or other pack-type designs) containing a flexible reservoir bag with a hose or outlet having a demand valve at its end. The reservoir contains a liquid for drinking which is accessed via the valve. Most valves require applying suction while simultaneously performing a bite or squeeze action of some sort with the teeth, tongue, or lips, which opens of the valve and allows the liquid to be drawn out through the hose. There are many valve designs on the market having distinct activating requirements.

When the pack is mounted on the user's back, the liquid is drawn from the reservoir up through a length of hose requiring moderate but notable suction. When the pack is waist-mounted, greater suction is required to raise the liquid to mouth level. The suction required by existing art hydration pacts is comparable to that needed to drink from a 24" to 30" vertical drinking straw. The dual requirements of creating suction and of valve manipulation while engaged in high levels of activity such as running or cycling is inefficient and cumbersome, and interferes with the user's breathing, concentration, and performance. Accordingly, there is a need for an improved liquid delivery system providing a more efficient delivery of liquid to individuals engaged in vigorous physical activity.

SUMMARY OF THE INVENTION

Applicant's pressure-assisted liquid delivery system described herein constitutes a radical improvement over the prior art. A reservoir for containing liquid is typically a seam-welded leak-proof bag made of flexible plastic materials which can withstand external pressure and compression. The reservoir has an exit port to which a length of hose is connected, and a fill port, or opening, which can be sealed shut by various means once the reservoir has been filled. In applicant's invention, once the reservoir has been filled and closed, a compressive force is applied to the reservoir by one of several means described below. The compressive force is such that the liquid contents of the reservoir are maintained under constant pressure, driving the pressurized liquid to flow through the hose to the valve. The valve system is operable under such pressure without leaking or dripping. Thus, once the user activates the valve, the compressive force in the reservoir causes the liquid to flow actively and rapidly into the mouth. No hydration system in the prior art provides such instant delivery of liquid on demand to the athlete or other physically active user.

Prior art hydration systems employ the conventional suction method requiring the user/athlete to interrupt breathing for long intervals in order to create suction, draw liquid up into the mouth, and swallow; draw and swallow, draw and swallow, gulp by gulp. Using applicant's pressure-assisted system, the drinking interval is completed substantially faster, typically in ¼ to ⅓ the time as compared to prior art hydration systems, because when the valve is activated, the pressurized liquid jets directly and immediately into the mouth leaving breathing rhythms uninterrupted, and preventing breathlessness.

It is commonplace in human beings to drink only once we are thirsty. By the time the "thirsty" sensation is detected and the person takes action, the body's hydration level may have fallen considerably below the optimum for best performance, especially during exertion. The pressure-assisted delivery system assists the user/athlete with drinking a larger quantity of liquid in a given period of time than would be possible using the prior art suction method, resulting in achievement of a greater, performance-enhancing hydrating effect at an earlier stage in the event or activity.

DETAILED DESCRIPTION OF THE ILLUSTRATED EMBODIMENTS

Figure 1:
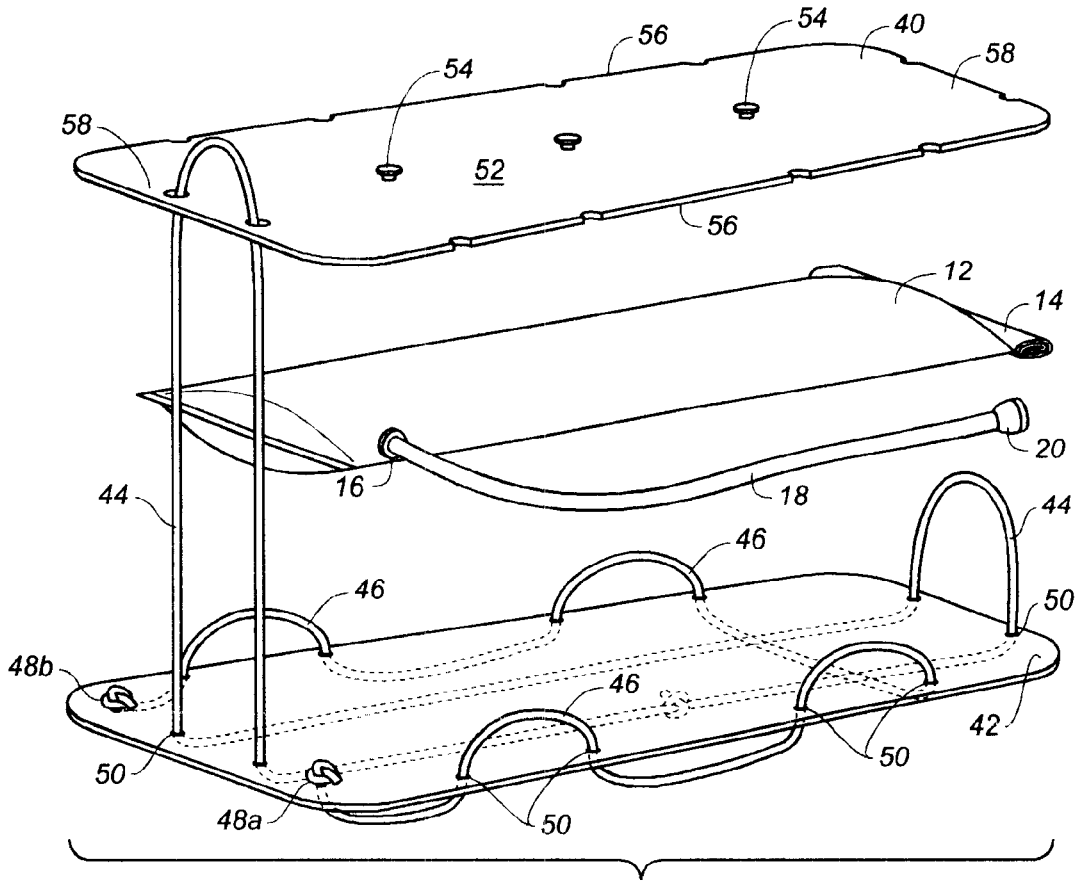
FIG. 1 is an exploded perspective view of a pressure-assisted liquid delivery system according to the invention.

A pressure-assisted liquid delivery system 10 is illustrated in the accompanying drawings and described below. The invention comprises a reservoir bag 12 for containing liquids to be consumed during a period of vigorous physical activity. The reservoir is preferably a flexible bag constructed of seam-welded plastic materials. It must be of sufficient strength to withstand the compressive forces exerted on it by the invention and remain leakproof The reservoir 12 is accessed through a fill port 14 for filling the bag with liquids and for cleaning. Ideally, the fill port consists of a fold-top bag closure as described in applicant's U.S. Patent application for a Fold-top Closure and Method Therefor, Application Ser. No. 09/513,322. The fold-top closure allows improved access to the reservoir for cleaning, allowing for a greater selection of liquids which can be contained in the reservoir, e.g., dairy products, is easy to use, and provides a leak-proof seal In other embodiments, the opening comprises a narrower neck, fill hose, or funnel.

The reservoir 12 further comprises an exit port 16 to which is attached a hose 18 having at its free end a demand valve 20. The demand valve 20 preferably is of the type which is mouth-activated by a biting or squeezing action, but which can withstand the compressive forces bearing on the reservoir and liquid contained therein without leaking. Applicant has determined that the Gulp valve manufactured for Bell Sports, Inc. by P&T Products, Ltd. of Hong Kong provides reliable performance.

Figure 2:
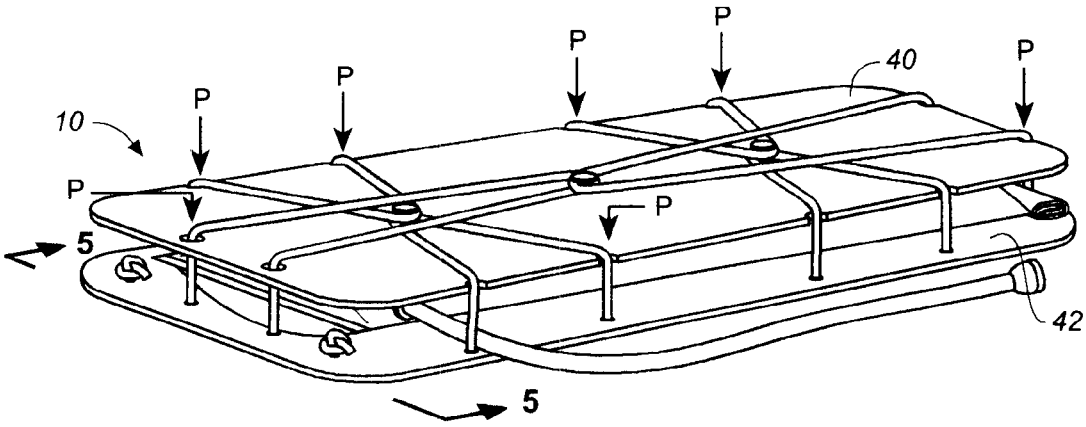
FIG. 2 is a perspective view of the liquid delivery system of FIG. 1 shown fully assembled.

The pressure-assisted liquid delivery system can best be seen in FIG. 1. The reservoir 12 is sandwiched between two semi-rigid plates, a top plate 40 and bottom plate 42. The plates are preferably constructed of polyethylene, but may be constructed of any polymer or cellulose providing sufficient rigidity characteristics. Both the top plate 40 and bottom plate 42 have lateral dimensions slightly greater than the lateral dimensions of the reservoir, allowing the plates to completely overlie and sandwich the reservoir, as seen in FIGS. 1 and 2. A plurality of loops of elastic rope extend from the edges of bottom plate 42, including two end loops 44 and two pairs of side loops 46. In the preferred embodiment, a single length of elastic rope is tied off at a first corner 48*a* (see FIG. 2), looped through holes 50 in the bottom plate 42 such that sufficient lengths of the elastic rope extend upwardly from the bottom plate along its edges to form side loops 46, and is tied off at second corner 48*b*. A second length of elastic rope, tied off below bottom plate 42 as seen in FIG. 1, is looped through holes 50 at each longitudinal end of bottom plate 42, and is of sufficient length to extend upwardly to form end loops 44. The elastic rope may consist of any heavy-duty elastic rope, such as Bungee® cord, that is strong enough to create the compressive forces needed.

Top plate 40 includes on a top surface 52 thereof a plurality of lugs 54 for removable attachment of loops 44 and 46. As best seen in FIG. 2, each pair of side loops 46 extends upwardly from the bottom plate, is drawn across side edges 56 of top plate 40, and is affixed to a single lug 54 in the top surface 52 of the top plate 40. End loops 44 are similarly configured, extending upwardly from bottom plate 42, drawn across or from end portions 58 of the top plate 40, and are mutually attached to a single lug 54 in a central area of the top plate. Both end and side loops are easily detachable from lugs 54 for providing easy access to the reservoir. Attachment of opposing pairs of side loops and end loops to single lugs negates stresses on the lugs and forms a web of loops extending across the entire top surface 52 of the top plate 40, thereby creating substantially uniform downward compressive force across the top plate for pressurizing the reservoir and its liquid contents, as seen in FIG. 2. Each loop has two ends extending upwardly from bottom plate 42 across an edge portion 56, 58 of top plate 40. The loops 44, 46 thereby form a plurality of primary compression points P coincident with each end of the loops around a common perimeter of the plates and the reservoir, for substantially uniform distribution of the compressive force of the elastic ropes across the plates.

Figure 5:
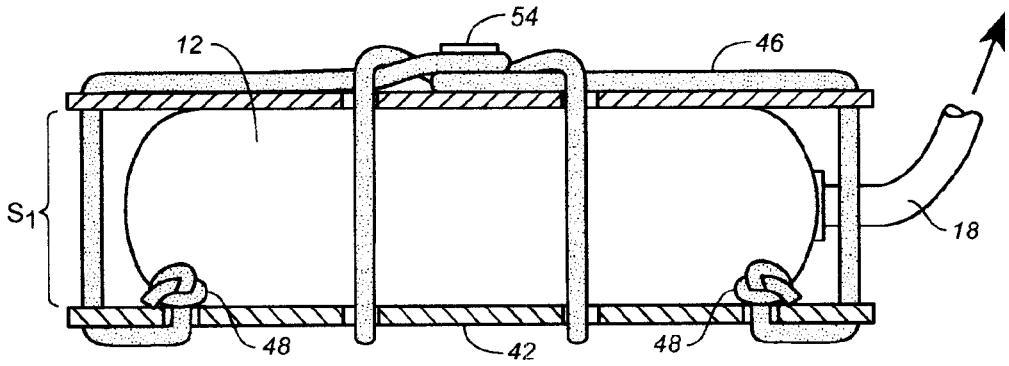
FIGS. 5 and 6 are end views of a pressure-assisted liquid delivery system according to the invention, showing a first position of plate separation wherein the reservoir is dilated, and a second position of plate separation wherein the reservoir is constricted.
Figure 6:
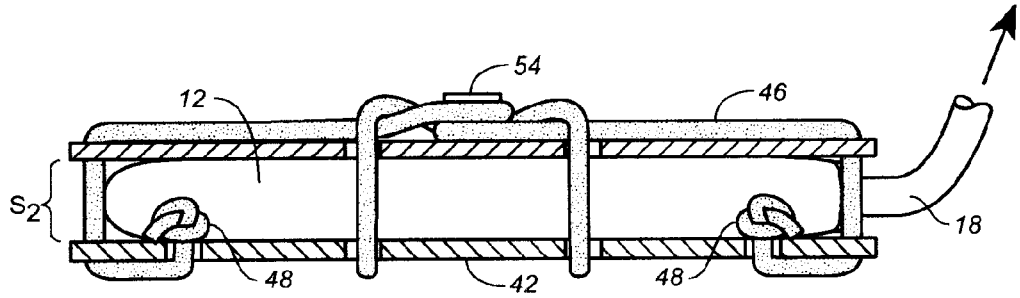
Figure 7:
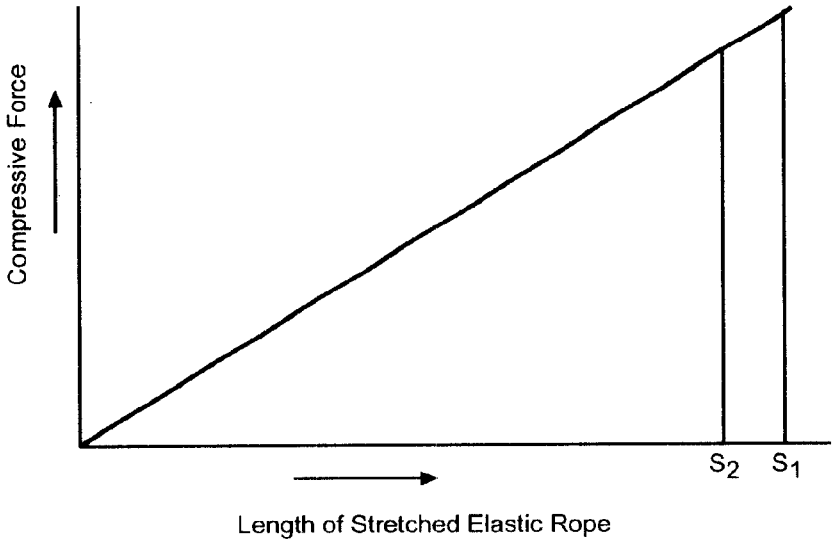
FIG. 7 is a chart relating the compressive force of the plates upon the reservoir to the stretched length of elastic loops used to compress the plates together.

Use of the invention is initiated by opening the reservoir 12, filling it with a selected liquid, and sealing the fill port closed. The reservoir is then positioned on bottom plate 42; top plate 40 is moved into a position overlying the reservoir, and loops 44, 46 are stretched and attached to lugs 54. The system is generally mounted vertically in a suitable backpack, with the exit port 16 located as low as possible. As the liquid is removed from the reservoir during use, plates 40, 42 move from a position of maximum separation $S_1$ as seen in FIG. 5 wherein the reservoir is fully dilated to a second position of closer separation $S_2$ as seen in FIG. 6 wherein the reservoir is constricted. Referring back to FIG. 1, by using a single lengths of elastic rope to form a plurality of loops, the apparatus takes advantage of the fact that the entire length of rope used will still remain substantially stretched as the plates move from first position $S_1$ to second position $S_2$. As graphically illustrated in FIG. 7, the relatively small incremental decrease in the stretched length of the rope effectively maintains the compressive force of the rope, and hence the plates, upon the reservoir at all points of separation between the plates. In other embodiments, the plurality of loops could be formed by individual lengths of rope, or by any plurality of ropes less than the total number of loops, so long as a compressive force sufficient to expel the reservoir's liquid contents through the hose and valve is maintained at all points of separation of the plates. In still other embodiments, the compressive force can be achieved by wrapping the plates and reservoir in an elastic web or in an elastic sock or by using mechanical assistance derived from springs or pumps.

Figure 3:
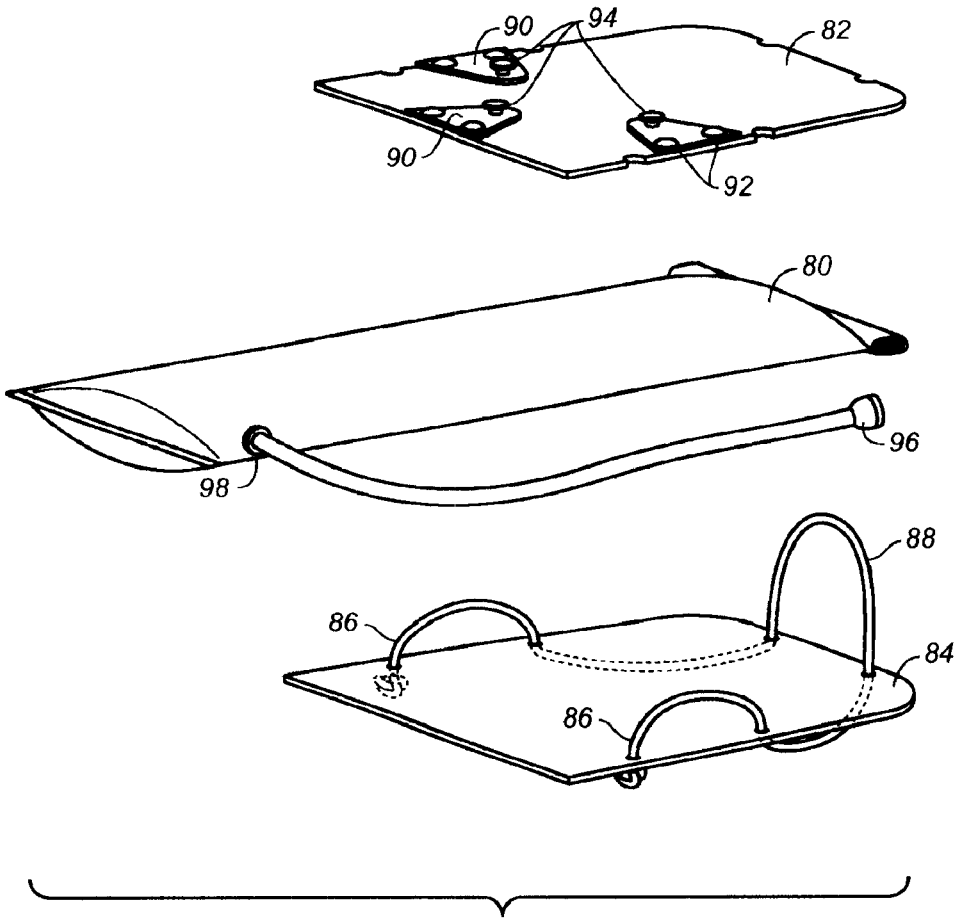
FIG. 3 is an exploded perspective view of an alternate embodiment of a pressure-assisted liquid delivery system according to the invention, having plates which cover half the reservoir.
Figure 4:
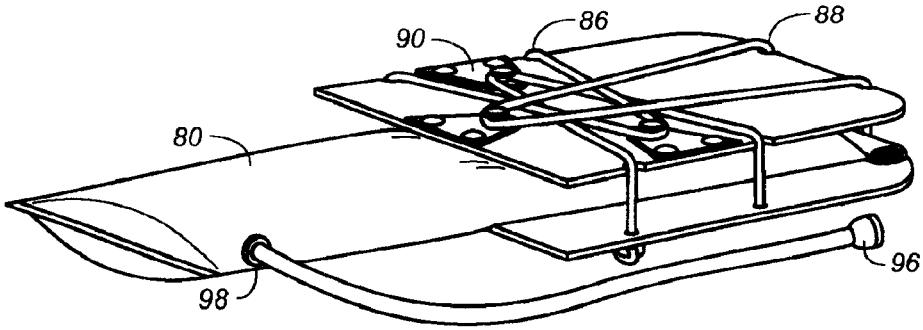
FIG. 4 is a perspective view of the liquid delivery system of FIG. 3 shown fully assembled.

A second embodiment of the invention is illustrated in FIGS. 3 and 4, comprising reservoir 80, similar in construction to reservoir 12 shown in FIG. 1, and dual compression plates consisting of top plate 82 and bottom plate 84. Plates 82 and 84 extend longitudinally only approximately half as far as plates 40 and 42 in the embodiment shown in FIGS. 1 and 2. Therefore, plates 82 and 84 cover only approximately half of reservoir 80. Two side loops 86 and one end loop 88 extend upwardly from edges of bottom plate 84. Side loops 86 and end loop 88 are preferably constructed from a single length of elastic rope, but in alternate embodiments, each loop is a single length of elastic rope. On top plate 82 are provided three gussets 90, which are attached to top plate 82 by rivets 92. In alternate embodiments, gussets 90 are attached to top plate 82 using adhesives or other means for attachment well known in the art. Preferably, gussets 90 are manufactured from a sturdy polyethylene, but in alternate embodiments are comprised of metal. Each gusset 90 includes a lug 94.

Once reservoir 80 has been filled and sealed, the top portion thereof as illustrated in FIG. 4 is sandwiched between plates 82 and 84, and loops 86 and 88 are stretched over edges of top plate 82 and removably attached to lugs 94. The configuration of lugs 94 in this embodiment has the advantage that side loops 86 are stretched substantially across the entire width of top plate 82, and end loop 88 is stretched approximately the entire length of plate 82. The longer extension of loops 86 and 88 minimizes the incremental reduction in the stretched length of these loops as plates 82 and 84 collapse toward each other during use of the system.

The half plates 82, 84 of the second embodiment of applicant's invention apply a compressive force to only the top half of the reservoir. Once the plates reach their closest relative separation, no further compressive force will bear on any liquid remaining in the lower portion of the reservoir. However, the compressive force bearing on the reservoir is small enough that, as needed, air can simply be blown back into the reservoir through demand valve 96, inflating the reservoir until fully dilated. Since the apparatus is carried with exit port 98 at the lowest vertical portion of the reservoir, reinflation of the reservoir recharges the compressive force bearing on the reservoir's contents, thereby again providing pressure-assisted liquid delivery upon activation of the valve. The half-plate embodiment of applicant's invention thus provides the benefits of reduced weight and manufacturing cost, simplified installation of a filled reservoir, and controlled pressure-assisted delivery of liquid upon recharging the reservoir.

Further embodiments of a pressure-assisted liquid delivery system, not illustrated, achieve the required compression using a tourniquet-style elastic webbing which is wrapped around the upper half of the reservoir. The elastic webbing avoids the need for rigid plates and attendant complications with their fabrication. This embodiment is used by filling and sealing shut the reservoir, then wrapping the webbing tightly around the reservoir, and fastening it in place using a hook-and-loop type fastener, snaps, conventional hooks, or other fastening means well known in the art.

Another embodiment of a pressure-assisted liquid delivery system comprises hinging the plates together, placing the reservoir between the hinged plates with the exit port disposed away from the hinge, and wrapping the free ends of the plates with an elastic rope or webbing to apply compressive force on the reservoir in the style of a clam shell. This embodiment allows easier access to the reservoir and simplifies assembly of the compression means.

A further embodiment of a pressure-assisted liquid delivery system, also not illustrated, comprises a fill valve disposed in a sidewall of the reservoir. Preferably the fill valve is of similar construction as fill valves used on bicycle inner tubes. The device is prepared for use by filling the reservoir and sealing it shut as usual, and then inflating the reservoir, using a bicycle pump or like means, to a level of pressure adequate to expel the liquid contents through the exit port and demand valve. Although this embodiment requires use of a pump, it eliminates the need for and cost of manufacturing the compression plates.

There have thus been described and illustrated certain preferred embodiments of a pressure-assisted liquid delivery system according to the invention. Although the present invention has been described and illustrated in detail, it should be clearly understood that the same is by way of illustration and example only and is not to be taken by way of limitation, the spirit and scope of the present invention being limited only by the terms of the appended claims and their legal equivalents.

What is claimed is:

1. A pressure-assisted liquid delivery system comprising:

a resealable flexible reservoir, said reservoir having contents, means for maintaining a manually-unassisted, constant, compressive force on said reservoir so that said contents of said reservoir are pressurized, a hose connected to an exit port in said reservoir, and a valve attached to a free end of said hose, said valve in communication with said contents of said reservoir, said valve having a closed position, said closed position for retaining said pressurized contents in said reservoir, and said valve having an open position, said open position for expelling said pressurized contents through said valve without applying a suction force to said valve.

2. The liquid delivery system of claim 1 wherein:

said means for maintaining a manually-unassisted, constant, compressive force comprises a pair of substantially rigid plates for sandwiching said reservoir, and means for urging said plates together.

3. The liquid delivery system of claim 2 wherein:

said reservoir includes a fold-top closure.

4. The liquid delivery system of claim 2 wherein:

said plates are movable from a first position of relative separation wherein said reservoir is fully dilated to a second position of relative separation wherein said reservoir is constricted, and said means for urging said plates together provides a consistent and substantially undiminished compressive force as said plates move between said first position and said second position.

5. The liquid delivery system of claim 2 wherein:

said plates include a top plate and a bottom plate, and said means for urging said plates together comprises at least one elastic rope, each said rope attached to said bottom plate and removably securable to said top plate for pressing said bottom plate towards said top plate at a plurality of compression points distributed around common edges of said plates and said reservoir for delivering approximately evenly distributed pressure across said plates on said reservoir.

6. The liquid delivery system of claim 5 wherein:

said plates overlie the reservoir, and said compression points are spaced approximately evenly around a common perimeter of said plates and said reservoir.

7. The liquid delivery system of claim 5 wherein:

said plates overlie half the reservoir, and said compression points are spaced approximately evenly around a top edge and two sides all common to said plates and said reservoir.

8. The liquid delivery system of claim 5 wherein:

said means for urging said plates together comprises a plurality of loops of elastic rope, each loop having two ends extending from said bottom plate, said top plate having means for affixing each said loop to a top surface thereof, each said loop drawn from an edge of said top plate and removably affixed to a top surface of said top plate.

9. The liquid delivery system of claim 8 wherein:

said plates are movable from a first position of relative separation in which said reservoir is fully dilated to a second position of relative separation in which said reservoir is constricted, when said plates in are said first position said plurality of loops are stretched to a first length for imparting a first compressive force onto said reservoir, and when said plates are in said second position said plurality of loops are stretched to a second length for imparting a second compressive force onto said reservoir which is substantially undiminished from said first compressive force, such that said plurality of loops provides a consistent and substantially undiminished compressive force as said plates move from said first position to said second position.

10. The liquid delivery system of claim 9 wherein:

said reservoir includes a roll-top closure.

11. The liquid delivery system of claim 8 wherein:

said top surface includes a plurality of lugs for affixing said loops.

12. The liquid delivery system of claim 11 wherein:

said loops overlap forming a web across said top surface of said top plate.

13. The liquid delivery system of claim 11 wherein:

said top plate includes two opposing end portions and two opposing side portions, and said loops comprise at least one end loop drawn from each of said end portions, and at least two side loops drawn from each of said side portions.

14. The liquid delivery system of claim 13 wherein:

each of said end loops is affixed to said top surface of said top plate approximately in a center portion thereof, and each of said side loops is affixed to said top surface of said top plate approximately adjacent the opposing side portion.

15. The liquid delivery system of claim 13 wherein:

each of said end loops is affixed to said top surface of said top plate approximately in a center portion thereof, and each of said side loops is affixed to said top surface of said top plate approximately midway between said side portions.

16. The liquid delivery system of claim 11 wherein:

said top plate includes two opposing side portions, and one end portion, and said loops comprise one end loop drawn from said end portion, and two side loops drawn from each of said side portions.

17. The liquid delivery system of claim 16 wherein:

said top plate includes a bottom portion opposed to said end portion, said bottom portion overlying a midportion of said reservoir, said end loop is affixed to said top surface of said top plate approximately adjacent to said bottom portion of said top plate, and each of said side loops is affixed to said top surface of said top plate approximately adjacent the opposing side portion.

18. A pressure-assisted liquid delivery system comprising:

a resealable reservoir, said reservoir having contents, a hose connected to an exit port in said reservoir, a valve attached to a free end of said hose, a pair of substantially rigid plates for sandwiching said reservoir, and means for urging said plates together for maintaining a manually-unassisted, constant, compressive force on said reservoir so that said contents of said reservoir are pressurized, said valve in communication with said contents of said reservoir, said valve having a closed position, said closed position for retaining said pressurized contents in said reservoir, and said valve having an open position, said open position for expelling said pressurized contents through said valve without applying a suction force to said valve.

19. The liquid delivery system of claim 18 wherein:

said plates include a bottom plate and a top plate, said bottom and top plates movable from a first position of relative separation wherein said reservoir is fully dilated to a second position of relative separation wherein said reservoir is constricted, and said means for urging said plates together provides a consistent and substantially undiminished compressive force as said plates move between said first position and said second position.

20. The liquid delivery system of claim 19 wherein:

said means for urging said plates together comprises at least one elastic rope, each said rope attached to said bottom plate and removably securable to said top plate for pressing said bottom plate towards said top plate at a plurality of compression points distributed around common edges of said plates and said reservoir for delivering approximately evenly distributed pressure across said plates on said reservoir.

21. The liquid delivery system of claim 20 wherein:

said means for urging said plates together comprises a plurality of loops of elastic rope, each loop having two ends extending from said bottom plate, said top plate having means for affixing each said loop to a top surface thereof, each said loop drawn from an edge of said top plate and removably affixed to a top surface of said top plate, said plates are movable from a first position of relative separation in which said reservoir is fully dilated to a second position of relative separation in which said reservoir is constricted, when said plates in are said first position said plurality of loops are stretched to a first length for imparting a first compressive force onto said reservoir, and when said plates are in said second position said plurality of loops are stretched to a second length for imparting a second compressive force onto said reservoir which is substantially undiminished from said first compressive force, such that said plurality of loops provides a consistent and substantially undiminished compressive force as said plates move from said first position to said second position.

22. The liquid delivery system of claim 21 wherein:

said top plate includes two opposing end portions and two opposing side portions, said loops comprise one end loop drawn from each of said end portions, and at least one side loop drawn from each of said side portions, and said top surface includes a plurality of lugs for affixing said loops.

23. The liquid delivery system of claim 21 wherein:

said top plate includes two opposing side portions and one end portion, said loops comprise one end loop drawn from said end portion, and at least one side loop drawn from each of said side portions, and said top surface includes at least one lug for affixing said loops.

24. A pressure-assisted liquid delivery system comprising:

a flexible reservoir, a hose connected to an exit port in said reservoir, a valve attached to a free end of said hose, a pair of substantially rigid plates for sandwiching said reservoir, said plates including a top plate and a bottom plate, and at least one elastic rope comprising a plurality of elastic loops, each said loop extending from said bottom plate and drawn across a top surface of said top plate from an edge thereof, said top surface of said top plate having a plurality of lugs, each said loop removably attached to one of said lugs, said plurality of loops forming a plurality of compression points distributed around common edges of said plates and said reservoir for delivering approximately evenly distributed pressure across said plates onto said reservoir, said top plate and bottom plate movable from a first position of relative separation in which said reservoir is fully dilated to a second position of relative separation in which said reservoir is constricted, said plurality of loops providing a consistent and substantially undiminished compressive force as said plates move from said first position to said second position, said compressive force pressurizing said reservoir such that when said valve is opened liquid contents of said reservoir are expelled through it without applying a suction force.

25. The liquid delivery system of claim 24 wherein:

said reservoir includes a resealable roll-top closure for accessing an interior thereof.

26. The liquid delivery system of claim 24 wherein:

said top plate includes two opposing end portions and two opposing side portions, and said loops comprise at least one end loop drawn from each of said end portions, and at least two side loops drawn from each of said side portions.

27. The liquid delivery system of claim 26 wherein:

each of said end loops drawn from opposing end portions is affixed to one of a plurality of lugs on said top surface of said top plate between said end loops, said side loops comprise a plurality of opposing pairs of side loops, and each of said pair of side loops is affixed to one of said plurality of lugs on said top surface of said top plate between said side portions.

28. The liquid delivery system of claim 26 wherein:

each of said end loops is affixed to said top surface of said top plate approximately in a center portion thereof, and each of said side loops is affixed to said top surface of said top plate approximately adjacent the opposing side portion.

29. The liquid delivery system of claim 24 wherein:

said top plate includes two opposing side portions, and one end portion, and said loops comprise at least one end loop drawn from said end portion, and at least two side loops drawn from each of said side portions.

30. The liquid delivery system of claim 29 wherein:

said side loops comprise at least one pair of opposing side loops, and each of said pairs of opposing side loops and each of said end loops is affixed to a lug on said top surface of said top plate between said side portions.

31. The liquid delivery system of claim 29 wherein:

said top plate includes a bottom portion opposed to said end portion, said bottom portion overlying a middle area of said reservoir, said end loop is affixed to said top surface of said top plate approximately adjacent to said bottom portion of said top plate, and each of said side loops is affixed to said top surface of said top plate approximately adjacent the opposing side portion.

32. The liquid delivery system of claim 1 wherein: said hose is flexible.

* * * * *